US006283651B1

(12) United States Patent
Holmberg

(10) Patent No.: US 6,283,651 B1
(45) Date of Patent: Sep. 4, 2001

(54) MOUNTING ARRANGEMENT FOR A PRINT HEAD IN A PRINTER

(75) Inventor: Robert Holmberg, Lerum (SE)

(73) Assignee: Intermec IP Corp, Woodland Hills, CA (US)

( * ) Notice: Subject to any disclaimer, the term of this patent is extended or adjusted under 35 U.S.C. 154(b) by 0 days.

(21) Appl. No.: 09/367,201

(22) PCT Filed: Feb. 3, 1998

(86) PCT No.: PCT/SE98/00188

§ 371 Date: Oct. 26, 1999

§ 102(e) Date: Oct. 26, 1999

(87) PCT Pub. No.: WO98/34791

PCT Pub. Date: Aug. 13, 1998

(30) Foreign Application Priority Data

Feb. 7, 1997 (SE) ..... 9700417

(51) Int. Cl.[7] ..... B41J 1/56

(52) U.S. Cl. ..... 400/174; 400/175; 400/320; 400/322; 347/8

(58) Field of Search ..... 400/120.16, 174, 400/175, 320, 322; 347/8, 53

(56) References Cited

U.S. PATENT DOCUMENTS 4,239,402 * 12/1980 Jung et al. ..... 400/175
4,381,896 * 5/1983 Shiurila ..... 400/320 X
4,682,188 * 7/1987 Castellano ..... 347/8
4,708,502 11/1987 Murakami ..... 400/175
5,146,849 * 9/1992 Johenning, II ..... 400/175 X

FOREIGN PATENT DOCUMENTS 0174817 3/1986 (IT) .
1291946 11/1989 (JP) .
0580330 1/1994 (JP) .

* cited by examiner

*Primary Examiner*—John S. Hilten
*Assistant Examiner*—Minh Chau
(74) *Attorney, Agent, or Firm*—Orum & Roth

(57) ABSTRACT

The invention relates to an arrangement for mounting a print head in a printer. The arrangement comprises a frame (1) to which a feeder device feeds a material to be printed which the printer will print on by means of a print head (3), movably arranged adjacent to a print roll (2) for being brought into, or out of, contact with the material to be printed. According to the invention, the arrangement uses a magnet (5) to hold the print head. Preferably, the print head is fitted in a fixture device (4), which is pivoting freely around a rear axle (7) parallel to the print roll, and the pressure is applied on the print head by a pressure member (6). The magnet (5) is preferably attached to the pressure member (6) so as to transfer pushing as well as pulling forces. The invention enables screws or fixed mounting of the print head to be avoided. The arrangement according to the invention also allows for the print head (3) pressure point to be transversally displaced. The arrangement has the property of being self-adjusting regarding the alignment of the print head in relation to the print roll (2).

11 Claims, 3 Drawing Sheets

MOUNTING ARRANGEMENT FOR A PRINT HEAD IN A PRINTER

FIELD OF THE INVENTION

The present invention relates to an arrangement for mounting a print head in a printer, and more particularly to an arrangement utilising a magnet for holding the print head. The invention enables the elimination of cumbersome mounting and dismounting of the print head. The arrangement according to the invention also allows for the print head pressure point to be transversely displaced. The arrangement shows the property of being self-adjusting, regarding the alignment of the print head and the pressure distribution, in relation to a print roll.

STATE OF THE ART

Today, screws are mainly used for mounting the print head into a printer. As it is important to maintain the print head parallel to the print roll, and to obtain an even pressure along the entire printing area, the position of the print head must be accurately adjusted. For this purpose, e.g. adjustment screws are used. When exchanging the print head, or after cleaning, the print head must be readjusted in order to obtain an appropriate printing quality. It is also possible for the print head to be dislodged if the printer is handled carelessly, e.g. if the printer has to be moved. In the previous technology, there is also no possibility of displacing the pressure point to adapt the pressure distribution of the printer to various paper widths.

The present invention solves the above problem by mounting the print head by means of a magnet. Due to this, no screws have to be loosened in order to remove the print head. The magnet is also easily transversely displaced, so as to adapt the print head pressure point to the paper width. The magnet has such a design that the print head has a certain liberty of pivoting around the pressure point. Guides see to that the print head will be automatically aligned parallel to the print roll and that the pressure is evenly distributed for optimum printing quality.

SUMMARY OF THE INVENTION

The present invention thus provides an arrangement for mounting a print head in a printer, comprising a frame to which a feeder device and a printing mechanism are fitted. The feeder device feeds a material to be printed on which the printer will print by means of a print head, movably arranged adjacent to a print roll for being brought into, or out of, contact with the material to be printed. According to the invention the print head is movably held by a magnetic device.

Preferably, the print head is fitted to a fixture device, which is pivoting freely around a rear axle parallel to the print roll, and pressure is applied on the print head by a pressure member. The magnetic device is preferably attached to the pressure member so as to transfer pushing as well as pulling forces.

The invention is defined by claim 1. Advantageous embodiments of the invention are defined in the dependent claims.

BRIEF DESCRIPTION OF THE DRAWINGS

The invention will be described in detail below, with reference to the accompanying drawings, of which.

DETAILED DESCRIPTION OF PREFERRED EMBODIMENTS

The drawings show a printer device utilising an arrangement according to the present invention. The printer may e.g. be of the thermo-transfer type or the direct thermo type, where the printing is performed by a print head with dots, generally arranged in a line on a print head. The dots are heated in order to act on a heat sensitive transfer paper or directly on the printing paper. The material to be printed is pulled by a print roll between said roll and the print head. To achieve appropriate printing quality, the print head should be arranged in a position where the line of dots is located parallel to the print roll, and preferably, the line should touch the tangent line of the print roll. It is also important that the pressure between the print head and the print roll is evenly distributed along the paper so as to cause an even blackening over the entire width of the paper.

Figure 1:
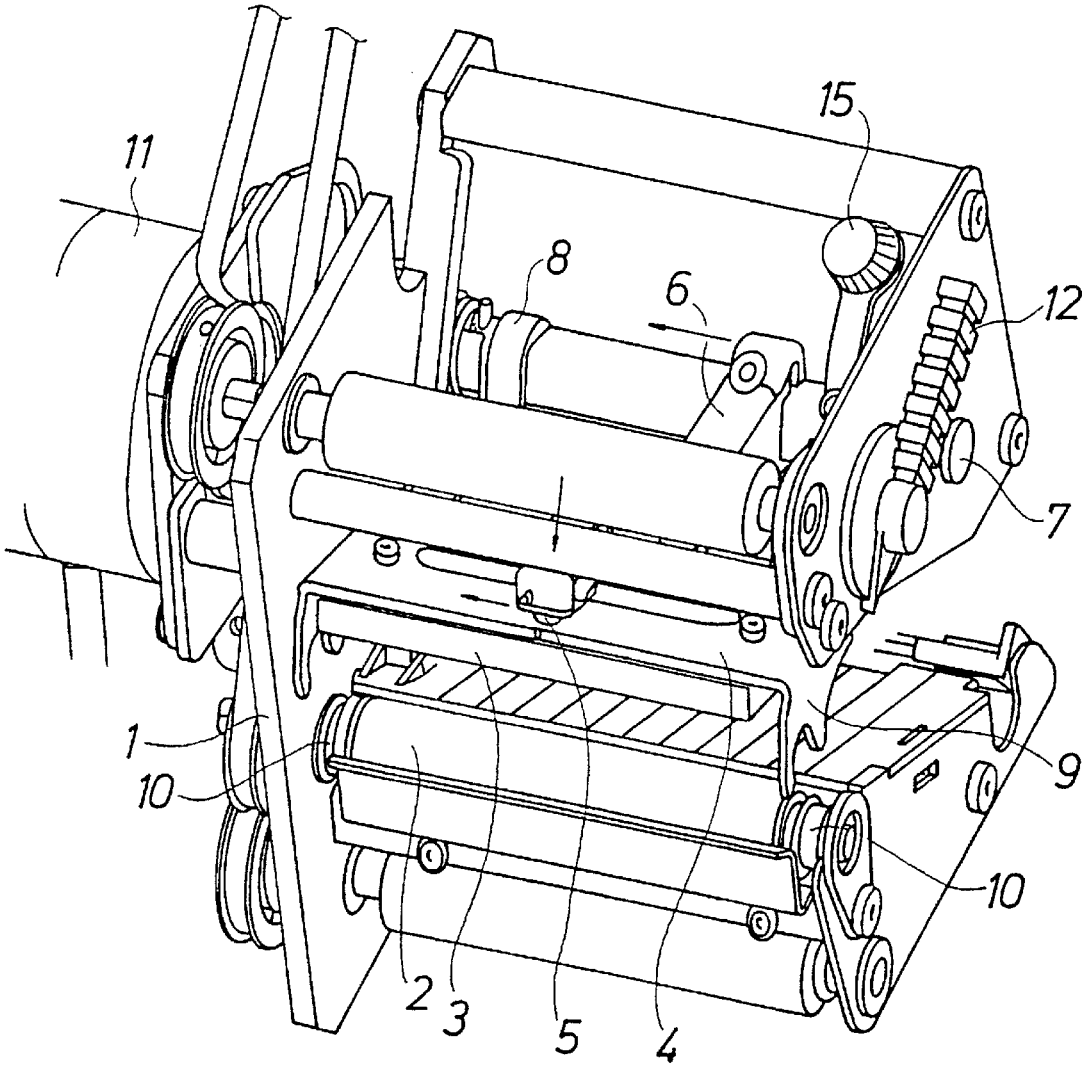
FIG. 1 is a view in perspective, from the front, of a printer comprising an arrangement according to the present invention.
Figure 2:
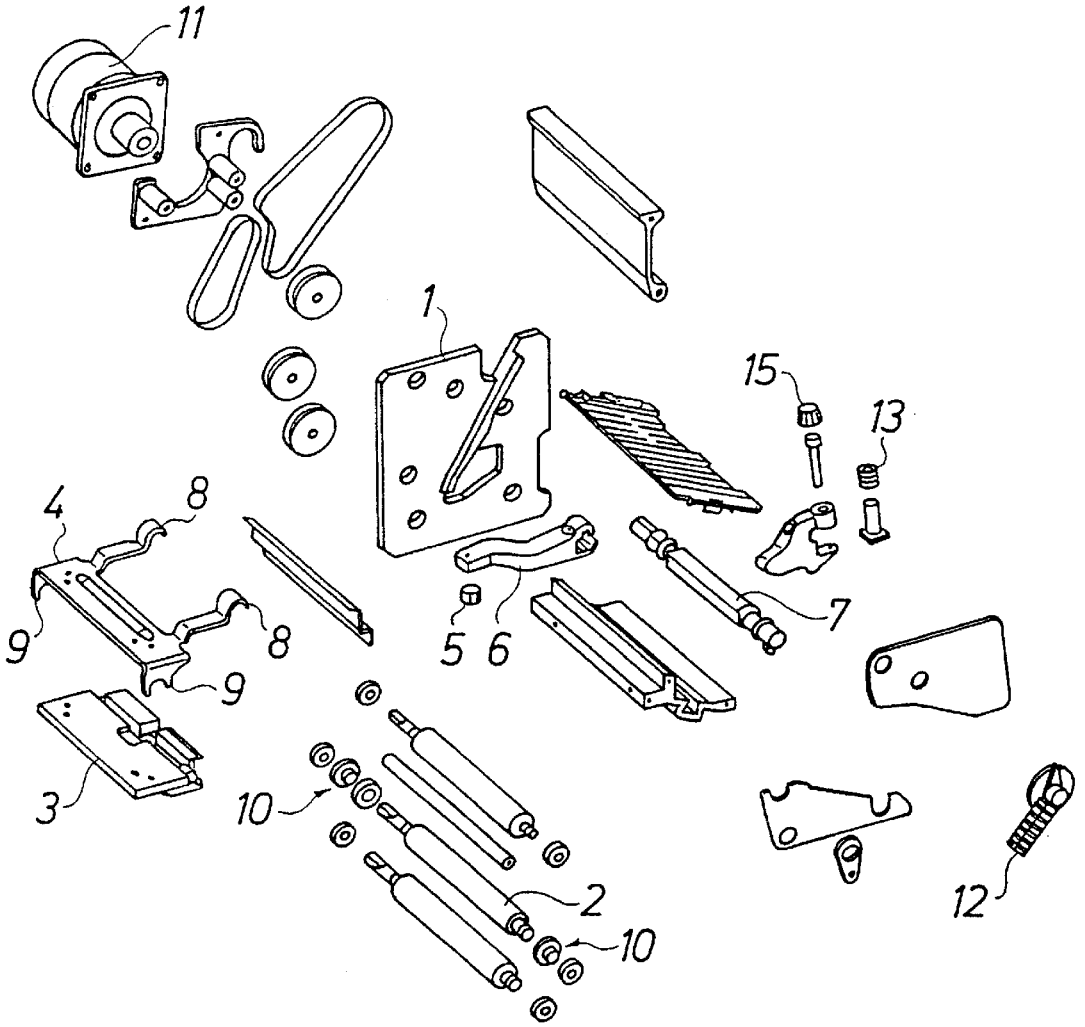
FIG. 2 is an exploded view of the printer.
Figure 3:
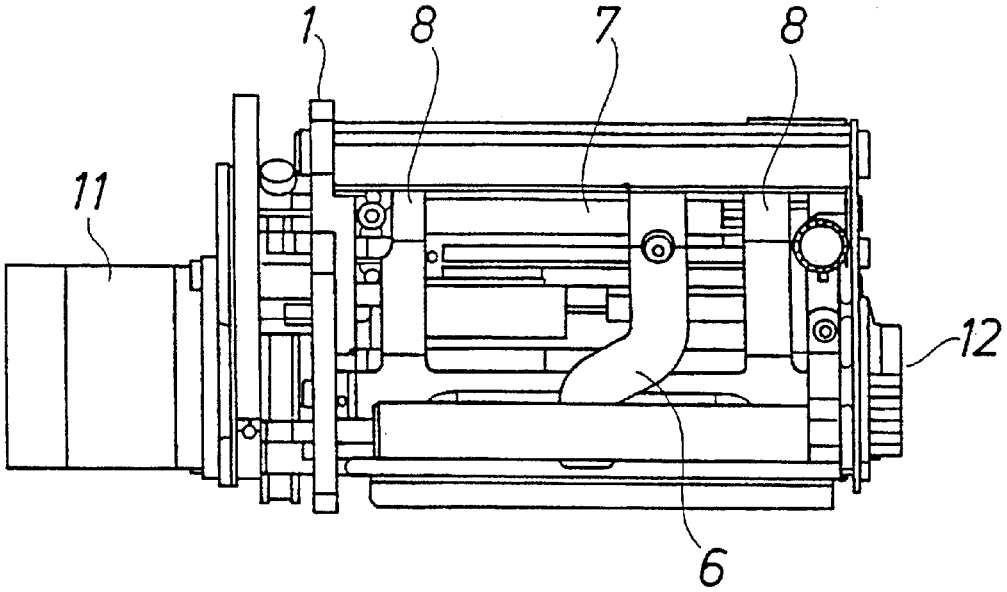
FIG. 3 is a top view of the printer, and FIGS. 4A. 4B and 4C are detail views of the magnet, whereby

With reference primarily to FIGS. 1 and 2, the printer device comprises a frame 1, onto which the other members are affixed. The printer of course contains a number of conventional components, well known to anyone skilled in the art and not explained in detail here. The printer is open on the right hand side for simple insertion of paper. The print roll is designated 2 and is driven by belts from the motor 11. The print head 3 is situated above the print roll 2, and is fixed to a fixture device or main plate 4 by means of screws or similar. In FIG. 1, the print head 3 is raised, and it should be understood that the print head 3 is moved down towards the print roll, with paper (not shown) between them when the printer is in printing mode.

A magnet 5, which will be described in more detail in connection with FIG. 4, holds the fixture device 4 and is pressed into a pressure member or lever 6. The magnet 5 transfers pressure downwards when the printer is in printing mode, and pulling forces upwards when the printer is in the open position shown in FIG. 1.

The lever 6 is rotationally fixed but displaceably mounted on a rear axle 7. The pressing force caused by rotation of the rear axle 7 is provided by e.g. a spring device 13 (FIG. 2). The spring force can be adjusted with a knob 15 and is set by means of a handle 12.

The fixture device 4 is also journalled on the rear axle 7, but can rotate freely and cannot be displaced, as the fixture device 4 is suspended from a pair of hooks 8. The hooks 8 are located at the rear ends of a pair of arms extending rearward from the print head mounting. When the printer is in the printing mode, there is no supporting force at the rear hooks 8, as the main pressure force is on the print head, but the hooks are disengaged with a small play, so as to allow the fixture device 4 a certain freedom of movement. When the fixture device 4 is in the printing mode, a pair of guide forks 9 co-operate with bushes 10 provided on both sides of the printing surface of the print roll 2. The guide forks 9 also have a certain clearance relative to the bushes 10, allowing the fixture device 4 to rotate somewhat around a horizontal axis, perpendicularly to the print roll 2. The guide forks 9, however, always hold the print head 3 parallel to the print roll 2, even if the print roll 2 is not perfectly parallel to the rear axle 7, due to mechanical deflections etc. During printing, the print head 3 is pushed forward, in such a manner that the rear surfaces of the guide forks 9, inside the recesses, co-operate with the bushes 10.

Figure 4A:
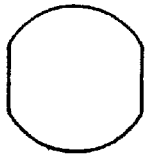
FIG. 4A shows the magnet from above, 4B from the side and 4C from the front side.
Figure 4B:
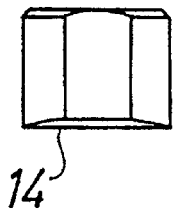
Figure 4C:
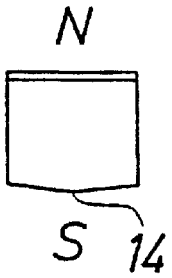

The structure of the magnet 5 is shown in FIGS. 4A to 4C. As can be seen from FIG. 4A, the magnet 5 is chamfered on the sides for being pressed into, and held steadily inside a bore (not visible) on the bottom side of the pressure member or lever 6. The lower end of the magnet exhibits a rounded, V-shaped tip or ridge 14, which is the only contact area between the pressure member 6 and the fixture device 4. The ridge 14 is maintained perpendicular to the print roll 2 thanks to the chamfers. It is to be understood that the fixture device 4 may thereby pivot around the pressure point, around a horizontal axis perpendicular to the print roll. The magnet is conveniently a strong type of permanent magnet. It is preferred that it is of the Neomagnet (NdFeB) type.

The present invention provides many advantages compared to the previously known art. The magnet suspension entails, that it is very easy to dismount the print head for replacement, cleaning or the like. No screws have to be removed, but the magnetic force is overcome manually and the fixture device with the hooks 8 is lifted off the axle 7 and removed. Replacing the print head takes place in the reverse fashion. When a new print head is fitted, its positioning does not have to be adjusted as the guide forks 9 provide a print head positioning exactly parallel to the print roll 2. The automatic pivoting of the print head around the pressure point of the magnet 5 also secures that the pressure will be evenly distributed over the material to be printed. In this way, any free play and clearances, and any mechanical deflections due to the asymmetrical suspension on the frame, are accomodated. The pressure point of the magnet 5 is placed centrally above the material to be printed., i.e. the pressure member 6 with the magnet 5 are displaced to the side if necessary, allowing the magnet to be located centrally above the paper when changing between different paper widths.

One embodiment of the invention has been described in detail for the sake of illustration only. Those skilled in the art will understand that many mechanical solutions within the invention could be achieved in alternative, equivalent ways. It is also feasible to exchange the permanent magnet for an electromagnet. The scope of the invention is only limited by the accompanying claims.

What is claimed is:

1. Arrangement for suspension of a printer print head, comprising:

a frame, a printable material feeding means, a printing means, the printable material feeding means and the printing means being operatively associated with the frame, a print roll, a print head, the print head being adjacent the print roll and being moveable to selectively contact a printable material, a magnetic print head holder, a rear axle, a print head fixture, the print head fixture being moveably suspended by the rear axle, and a print head pressure element, the print head pressure element being arranged and constructed to selectively exert a force on the print head.

2. Arrangement for suspension of a printer print head according to claim 1, wherein the print head pressure element is rotatably attached on the rear axle.

3. Arrangement for suspension of a printer print head, according to claim 1, wherein the print head pressure element is moveably attached on the rear axle.

4. Arrangement for suspension of a printer print head according to claim 1, wherein the print head is disposed parallel to the print roll, the print head fixture further comprising a mounting plate, and at least two extended arms, the print head being fixable to the mounting plate, and the arms being suspendable around the rear axle.

5. Arrangement for suspension of a printer print head according to claim 4, wherein the arms further comprise hooks disposed at rear sections of the arms, the hooks being arranged and constructed to journal around the rear axle.

6. Arrangement for suspension of a printer print head according to claim 4, wherein the print head fixture further comprises at least two forks, the forks being extendable in a downward direction to cooperate with the print roll.

7. Arrangement for suspension of a printer print head according to claim 6, further comprising a bushing disposed at each side of the print roll, the forks being journaled in the bushings.

8. Arrangement for suspension of a printer print head according to claim 1, the magnetic print head holder being connectable with the print head pressure element, wherein both pushing and pulling forces are transmittable.

9. Arrangement for suspension of a printer print head according to claim 8, the magnetic print head holder having a rounded contact surface, wherein the print head is pivotable around the rounded contact surface as force is transferred to the print head.

10. Arrangement for suspension of a printer print head according to claim 1, wherein a magnetic print head holder is a permanent magnet.

11. Arrangement for suspension of a printer print head according to claim 10, where in the permanent magnet is a neomagnet.

* * * * *